US011566823B1

(12) United States Patent
Feria

(10) Patent No.: US 11,566,823 B1
(45) Date of Patent: Jan. 31, 2023

(54) HEAT EXCHANGER SYSTEMS

(71) Applicant: Ralph Feria, Easley, SC (US)

(72) Inventor: Ralph Feria, Easley, SC (US)

( * ) Notice: Subject to any disclaimer, the term of this patent is extended or adjusted under 35 U.S.C. 154(b) by 0 days.

(21) Appl. No.: 17/722,098

(22) Filed: Apr. 15, 2022

(51) Int. Cl.
*F25B 30/02* (2006.01)
*F25B 9/00* (2006.01)
*F25B 13/00* (2006.01)

(52) U.S. Cl.
CPC ..... *F25B 30/02* (2013.01); *F25B 9/006* (2013.01); *F25B 13/00* (2013.01)

(58) Field of Classification Search
CPC ..... F25B 30/02; F25B 9/006; F25B 13/00
See application file for complete search history.

(56) References Cited

U.S. PATENT DOCUMENTS 5,233,842 A * 8/1993 Manning ..... F25B 43/006 62/472
6,463,757 B1 * 10/2002 Dickson ..... F25B 43/006 62/509

* cited by examiner

*Primary Examiner* — Ana M Vazquez
(74) *Attorney, Agent, or Firm* — Fox Rothschild LLP; Thomas W. Epting; P. Marshall Ticer

(57) ABSTRACT

Heating and cooling optimization systems are disclosed. Such systems may include a superheater and desuperheater are disclosed. An example superheater may include a combined suction line accumulator and heat exchanger configured to receive a heated fluid from an external source. An example desuperheater may comprise an accumulation tank and a heat exchanger configured to receive a relatively cool fluid from an external source. Various external sources may be a solar thermal source, a wood chip boiler, a ground loop, a geothermal source, an attic space, a garage, and/or a chemical heat source. Disclosed heating and cooling systems may include a controller sub-system for selectively modulating a flow rate of heated fluid through the superheater and for selectively modulating a flow rate of cooled fluid through the desuperheater.

9 Claims, 12 Drawing Sheets

HEAT EXCHANGER SYSTEMS

CROSS REFERENCE TO RELATED APPLICATIONS

This application incorporates by reference the entire disclosure of U.S. patent application Ser. No. 16/821,692, titled Valve System and Methods, filed Mar. 17, 2020 and U.S. Pat. No. 11,067,317, titled Heat Source Optimization System, filed Jan. 30, 2018.

FIELD

In an aspect, the present disclosure relates generally to methods of using a superheater, e.g., disclosed suction superheaters, for prewarming refrigerant of a heat pump system. In another aspect, the present disclosure relates generally to the field of heat exchanging systems including the use of superheaters and desuperheaters for use with fluid heating and cooling systems, including heating, ventilation, and air conditioning (HVAC) systems and refrigeration, fluid heating and chilling systems, and systems for heating pools, spas, and the like.

BACKGROUND

Various systems are available for heating, ventilation, air conditioning, refrigeration, fluid heating, and chilling. Such systems can be dedicated to heating or to cooling, or both. For example, in the case of heat pump systems, the direction of a refrigerant flow can be reversed through heat exchangers to either allow for absorption of heat from a living and/or workspace for the cooling such space or for absorption of heat from the outdoors for the heating of such space. Typically, in such arrangements forced-air flows over the heat exchanger before being supplied to such living and/or workspace.

SUMMARY

The techniques of this disclosure generally relate to heating and cooling by selectively modulating a fluid flow of secondary fluid through a suction superheater and/or a desuperheater. In an aspect, the present disclosure relates to a method and apparatus for improving heat pump systems such that they are effective at relatively colder ambient temperatures. Disclosed systems may improve the operating efficiency of heat pump systems such that they are efficient at temperatures as low as −30 degrees Fahrenheit (about −30.5 Celsius). For example, disclosed systems may provide a secondary heated fluid to a suction superheater downstream of a compressor that warms the primary recirculating refrigerant via a heat exchange process before the primary refrigerant is received by a compressor.

In one aspect, the present disclosure provides for a heat optimization system including a suction superheater. The heat exchanger may include a tank extending in a longitudinal direction, the tank defining an interior cavity having an uppermost surface, a lowermost surface opposite the uppermost surface, and a sidewall extending from the uppermost surface to the lowermost surface, for example. In various exemplary implementations, the interior cavity may include an upper region proximate the uppermost surface, a lower region proximate the lowermost surface, and a medial region between the upper region and lower region. In various exemplary implementations, the system may include a refrigerant input line disposed within the tank and extending from the upper region to at least the medial region, the refrigerant input line being configured to receive input refrigerant from a first supply line outside the tank in a vaporized state, semi-vaporized state, and/or a saturated state and release the input refrigerant into the interior cavity through a first output orifice proximate the medial region and/or a second output orifice proximate the lower region, for example. In various exemplary implementations, a refrigerant output line may be disposed within the tank and have a generally U-shape including a first portion and a second portion joined together by a third portion. In various exemplary implementations, the first portion may extend from an input orifice proximate the upper region to the third portion, the third portion may be disposed proximate the lower region and include an oil return inlet therein, and the second portion may extend from the third portion to the upper region. In various exemplary implementations, the refrigerant output line may be configured to draw vaporized refrigerant from within the tank through the input orifice and draw liquid refrigerant and/or oil from within the tank through the oil return inlet and provide the vaporized refrigerant, liquid refrigerant, and/or oil together as output refrigerant to a second supply line outside of the tank. In various exemplary implementations, a heating line may be disposed within the tank, the heating line may include a plurality of coils that are wound around the refrigerant input line and refrigerant output line, and the heating line may be configured to receive a heated fluid from an external heat source. In various exemplary implementations, the heating line increases the temperature of the input refrigerant.

In another aspect of the present disclosure, a heat optimization system including a desuperheater, is disclosed. Various exemplary implementations may include a tank defining an interior cavity having an uppermost surface, a lowermost surface opposite the uppermost surface, and a sidewall extending from the uppermost surface to the lowermost surface. In various exemplary implementations, a refrigerant input line may be disposed within the tank and extend from the upper region to at least the medial region, the refrigerant input line being configured to receive input refrigerant from a first supply line outside the tank in a vaporized state, semi-vaporized state, and/or a saturated state and release the input refrigerant into the interior cavity through a first output orifice. In various exemplary implementations, a refrigerant output line may be disposed within the tank, the refrigerant output line being configured to draw refrigerant from within the tank through an input orifice and provide the refrigerant to a second supply line outside of the tank. In various exemplary implementations a cooling line may be disposed within the tank, the cooling line including a plurality of coils that are wound around the refrigerant output line, the cooling line being configured to receive a cooled fluid from an external source. In various exemplary implementations, the cooling line decreases the temperature of the input refrigerant.

In another aspect, an apparatus is disclosed. The apparatus may include a chamber defining an interior cavity having an upper wall portion, a lower wall portion, and a sidewall portion extending between the upper wall portion and the lower wall portion, for example. The apparatus may include a first conduit disposed within the chamber and extending from proximate the upper wall portion to proximate the sidewall portion; the first conduit being configured to receive refrigerant from a refrigerant supply outside the chamber in a vaporized state and/or a saturated state and discharge the refrigerant into the interior cavity through at least one discharge orifice proximate the sidewall portion and/or proximate the lower wall portion, for example. The apparatus may include a generally U-shaped second conduit disposed within the interior cavity having a inlet port proximate the upper wall, a discharge port extending from the interior cavity to outside the chamber, and a metering port proximate the lower wall portion; the inlet port being configured to intake vaporized or semi-vaporized refrigerant from the interior cavity, for example. In various exemplary implementations, the oil return inlet may be configured to intake liquid refrigerant and/or oil from the interior cavity, and the second conduit may be configured to deliver vaporized refrigerant from the inlet port and liquid refrigerant from the oil return inlet to the discharge port outside of the chamber. In various exemplary implementations, a fluid conduit may be disposed within the interior cavity and coiled about the first conduit and the second conduit and configured to receive a heated fluid from heat source external to the chamber. In various exemplary implementations, the heated fluid acting through the fluid conduit increases the temperature of the refrigerant in at least one of the interior cavity, the first conduit, and the second conduit.

In another aspect, an apparatus is disclosed. The apparatus may include a chamber defining an interior cavity having an upper wall portion, a lower wall portion, and a sidewall portion extending between the upper wall portion and the lower wall portion, for example. The apparatus may further include a first conduit disposed within the chamber and extending from proximate the upper wall portion to proximate the sidewall portion; the first conduit being designed to receive refrigerant from a refrigerant supply outside the chamber in a vaporized state and/or a saturated state and discharge the refrigerant into the interior cavity through at least one discharge orifice proximate the sidewall portion and/or proximate the lower wall portion, for example. The apparatus may further include a generally U-shaped second conduit disposed within the interior cavity having a inlet port proximate the upper wall, a discharge port extending from the interior cavity to outside the chamber, and a metering port proximate the lower wall portion; the inlet port being configured to intake vaporized or semi-vaporized refrigerant from the interior cavity, the oil return inlet being configured to intake liquid refrigerant and/or oil from the interior cavity, and the second conduit being configure to deliver vaporized refrigerant from the inlet port and liquid refrigerant from the oil return inlet to the discharge port outside of the chamber, for example. The apparatus may further include a fluid conduit disposed within the interior cavity and coiled about the first conduit and the second conduit and configured to receive a heated fluid from heat source external to the chamber, for example. In various embodiments, the heated fluid acting through the fluid conduit increases the temperature of the refrigerant in at least one of the interior cavity, the first conduit, and the second conduit, for example.

In another aspect, a heating and cooling system is disclosed. The system may include a heat exchanger; a first recirculating flow path for refrigerant; a second recirculating flow path for a heated fluid; and an indoor air flow path for an indoor air heating and cooling system, for example. In various embodiments, the heat exchanger may include a refrigerant flow path in fluid communication with the first recirculating flow path via a first input orifice and a first output orifice, the refrigerant flow path being configured to receive refrigerant in a vaporized state and/or a saturated state at the input orifice and discharge refrigerant in a substantially vaporized state via the output orifice, for example. In various embodiments a heated fluid flow path may be in fluid communication with the second recirculating flow path via a second input orifice and a second output orifice, the heated fluid flow path being configured to transfer heat to the refrigerant flow path, for example. The system may further include a pump in fluid communication with the second recirculating line; a first temperature sensor in fluid communication with the first recirculating line upstream of the suction superheater; a second temperature sensor in fluid communication with the first recirculating line downstream of the suction superheater; and a reversing valve in fluid communication with the recirculating flow path, for example. The system may further include a controller in communication with the first temperature sensor and second temperature sensor, the controller having at least one processor and computer readable memory storing computer executable instructions thereon, for example. When the instructions are executed, the system may acquire a first temperature measurement from the first temperature sensor; acquire a second temperature measurement from the second temperature sensor; determine if the second temperature is within a target operating range; modulate a speed of the pump if the second temperature is outside the target operating range; and toggle the reversing valve to change a flow path of refrigerant between the first recirculating flow path and/or the indoor air flow path, for example.

In another aspect, the system the heat exchanger is a suction superheater, for example.

In another aspect, the heat exchanger is a brazed plate heat exchanger including a plurality of plates that the refrigerant and heated fluid pass over along separate flow paths without mixing, for example.

In another aspect, the heat exchanger is a tube and shell heat exchanger including a plurality of interconnected tubes and a shell, the plurality of interconnected tubes defining the heated fluid flow path and the shell defining the refrigerant flow path, for example.

In other aspects, the present disclosure includes methods of using a suction superheater for prewarming refrigerant of a heat pump system.

In another aspect, the present disclosure includes the use of superheaters and/or desuperheaters with fluid heating and cooling systems, including HVAC, fluid heating and chilling systems, refrigeration systems, chiller systems, and systems for heating pools, spas, and the like.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

Figure 1:
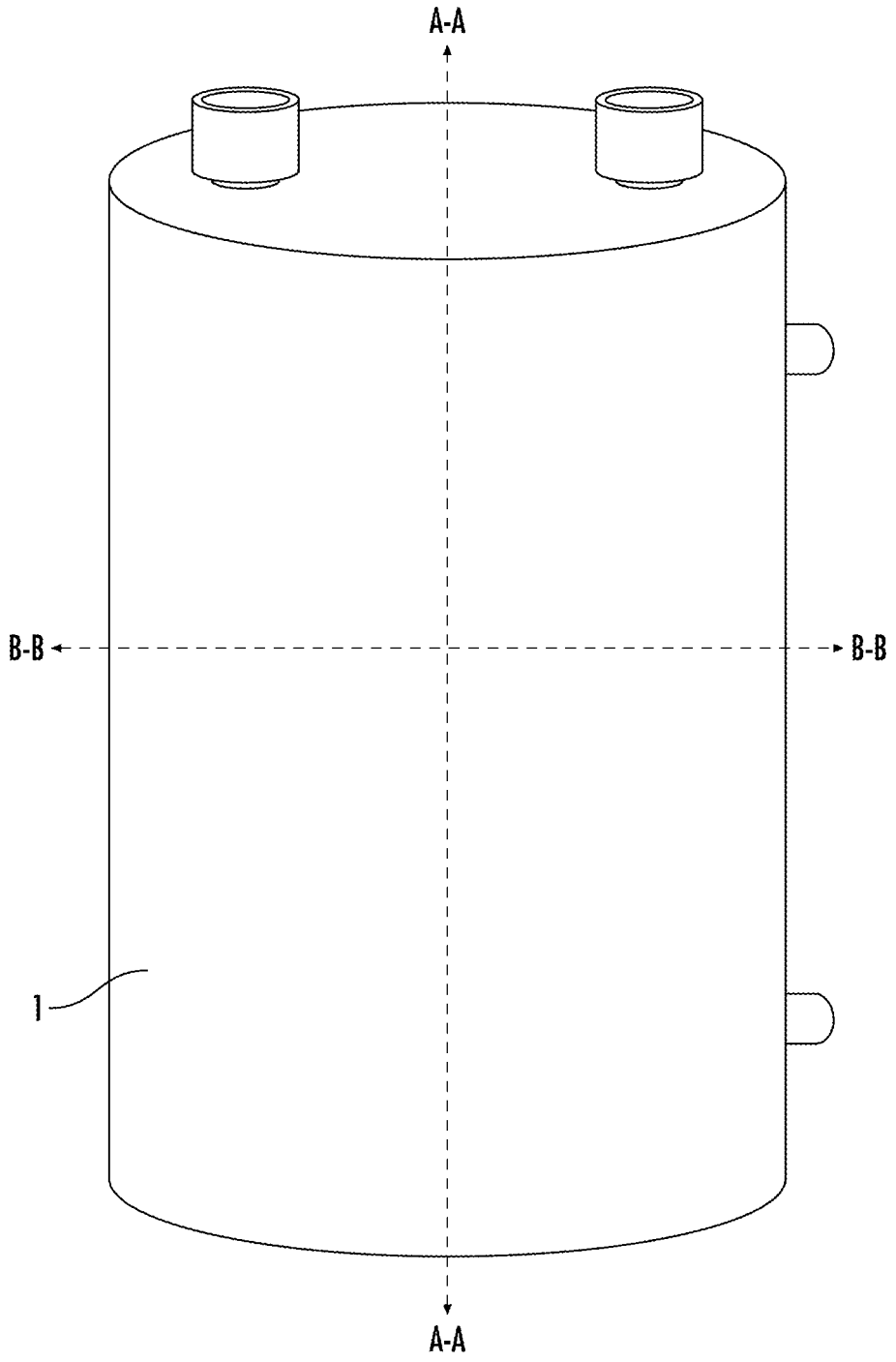
FIG. 1 is a front perspective view of a superheater system including a suction superheater for introducing heat.

The accompanying drawings and the description which follows set forth example implementations of the present disclosure. However, it is contemplated that persons generally familiar with heat pump systems will be able to apply the novel characteristics of the structures illustrated and described herein in other contexts by modification of certain details. Accordingly, the drawings and description are not to be taken as restrictive on the scope of the present disclosure, but are to be understood as broad and general teachings.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below. Some implementations of the present disclosure will now be described more fully hereinafter with reference to the accompanying drawings, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of one or more other items, e.g., a "first" or lower-numbered item, and/or, e.g., a "third" or higher-numbered item. Further, although reference may be made herein to a number of measures, predetermined thresholds and the like such as times, distances, speeds, temperatures, flow rates, voltages, power, coefficients, pressures, humidities, percentages and the like, according to which aspects of example implementations may operate; unless stated otherwise, any or all of the measures/predetermined thresholds may be configurable. Like reference numerals refer to like elements throughout.

As used herein, "and/or" means any one or more of the items in the list joined by "and/or." Further, as used herein, the term "exemplary" means serving as a non-limiting example, instance, or illustration. Moreover, as used herein, the term, for example, or "e.g.," introduces a list of one or more non-limiting examples, instances, or illustrations.

It is noted that various exemplary implementations are described in detail with reference to the drawings, in which like reference numerals represent like parts and assemblies throughout the several views, where possible. Reference to various exemplary implementations does not limit the scope of the claims appended hereto because the exemplary implementations are examples of the inventive concepts described herein. Additionally, any example(s) set forth in this specification are intended to be non-limiting and set forth some of the many possible implementations or embodiments applicable to the appended claims. Further, particular features described herein can be used in combination with other described features in each of the various possible combinations and permutations unless the context or other statements clearly indicate otherwise.

Terms such as "same," "equal," "planar," "coplanar," "parallel," "perpendicular," etc. as used herein are intended to encompass a meaning of exactly the same while also including variations that may occur, for example, due to manufacturing processes. The term "substantially" may be used herein to emphasize this meaning, particularly when the described implementation or embodiment has the same or nearly the same functionality or characteristic, unless the context or other statements clearly indicate otherwise.

Figure 2A:
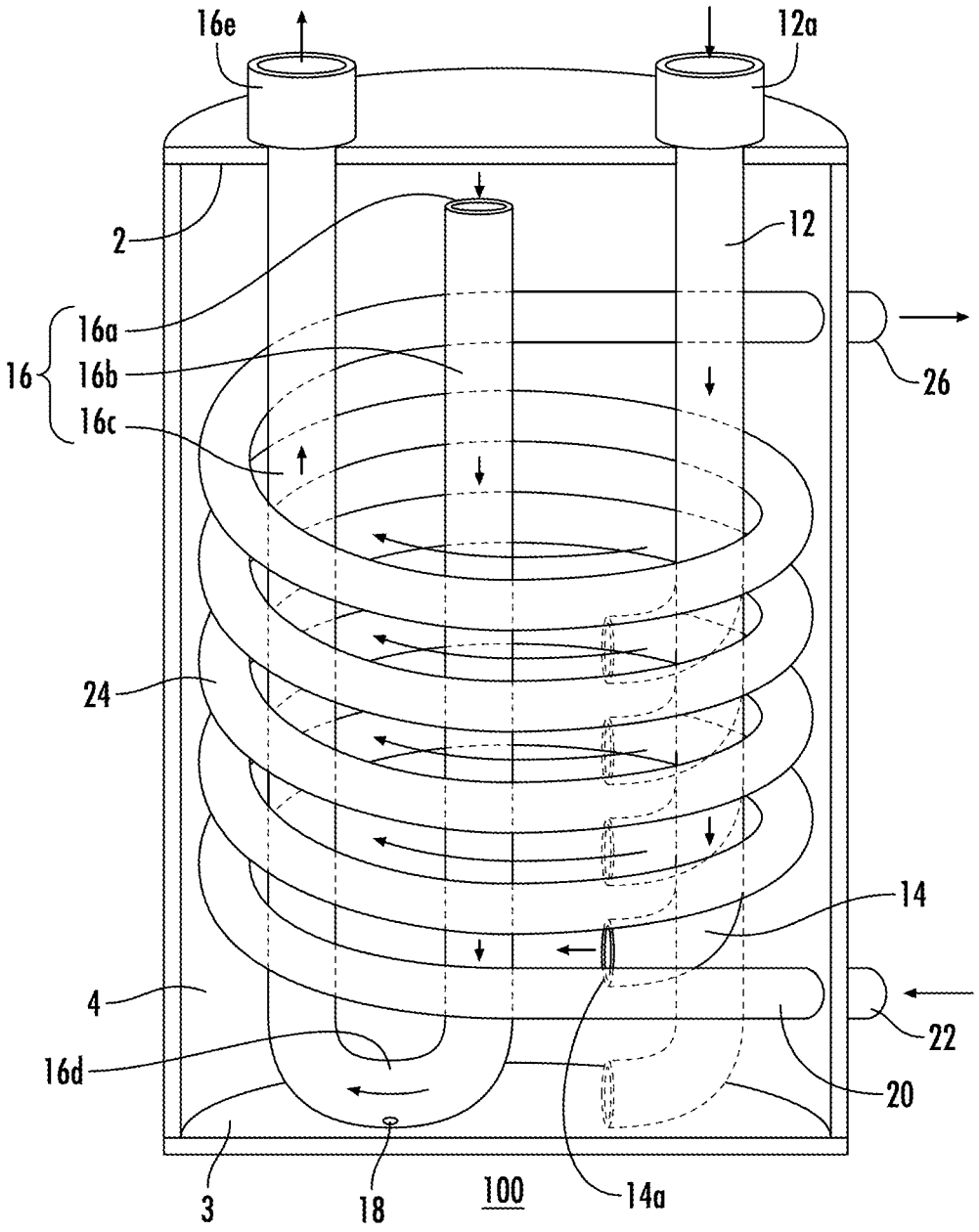
FIG. 2A is an exposed parts view of the interior of a first exemplary implementation of a superheater system including a suction superheater for introducing heat.
Figure 2B:
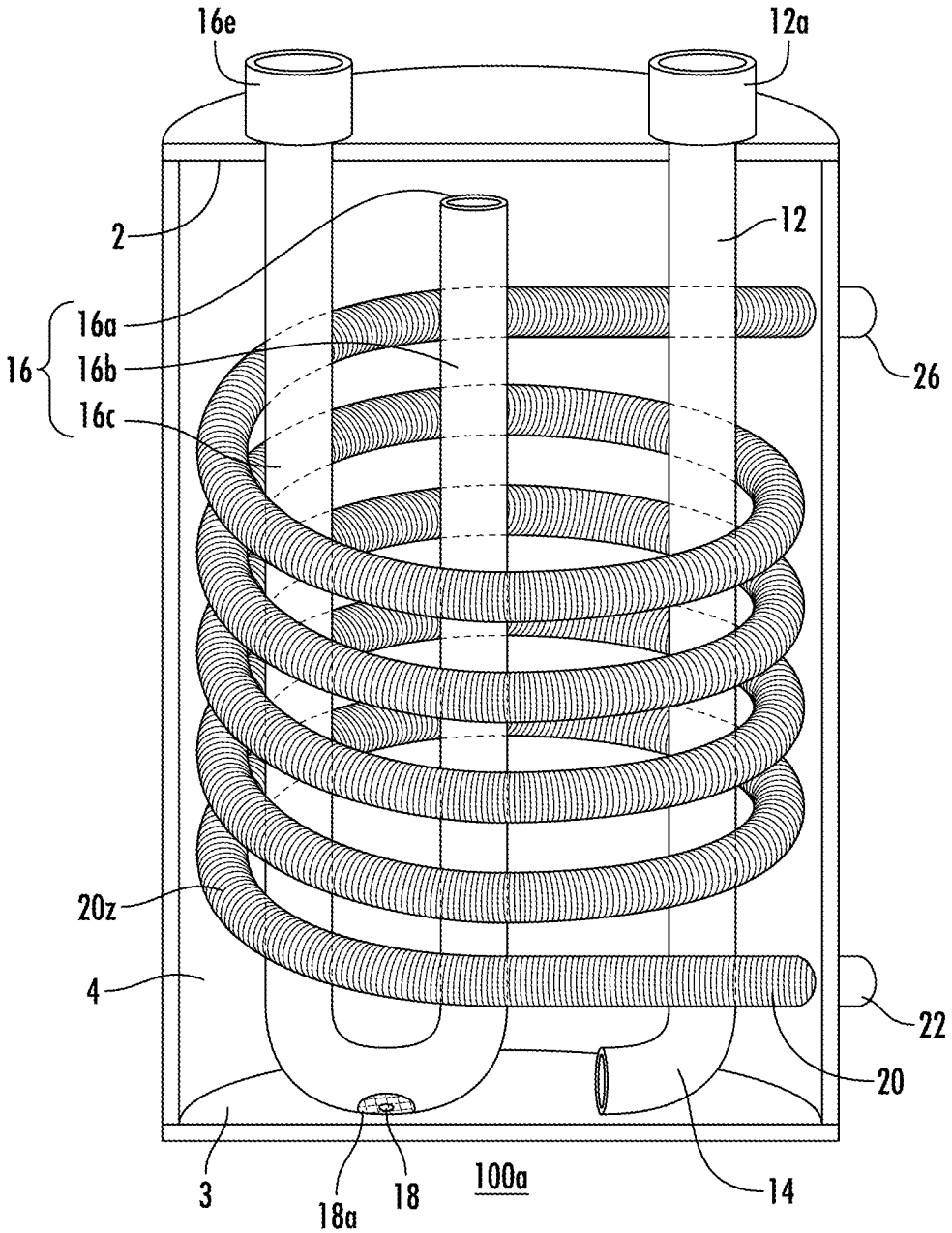
FIG. 2B is an exposed parts view of the interior of a second exemplary implementation of a superheater system including a suction superheater for introducing heat.

Referring generally to FIGS. 1, 2A, and 2B a superheater system 100 is disclosed. In some implementations, the superheater system may be referred to as a suction superheater and serve the purpose of introducing heat into a refrigerant conduit system downstream of a compressor. As used herein, the term "refrigerant" shall have its broad ordinary technical meaning in the fluid heating, cooling, and ventilation arts. Example refrigerants may include: Chlorofluorocarbons (CFCs), Hydrofluorocarbons (HFCs), Hydrochlorofluorocarbons (HCFCs), and Natural Refrigerants.

Suction superheater 100 may include a tank 1 taking an elongate cylindrical shape that defines an interior chamber or cavity. In the example implementation, tank 1 extends in a longitudinal direction along axis A-A and extends in a lateral direction along axis B-B. In other implementations, housing 1 may take any shape, e.g., square, circular, oval, etc. As seen best in FIG. 2A, the interior cavity defined by tank 1 may include an upper surface 2, lower surface 3, and a sidewall extending from the uppermost surface 2 to the lowermost surface 3. In this implementation, suction superheater 100 functions like a heated suction line accumulator in that the interior cavity of tank 1 is sealed and may receive refrigerant in a vaporized state, semi-vaporize state and/or saturated state. For example, refrigerant may enter suction superheater 100 via input port 12*a* of refrigerant input line 12. Input line 12 may enter tank 1 by passing through the uppermost surface 2 in a substantially longitudinal direction and may include at least one output section 14 for releasing the refrigerant into the interior of tank 1 at outlet opening 14*a*. Output section 14 may be gently curved such that at output section 14 the input line 12 transitions from a substantially longitudinal direction to a substantially lateral direction by making an approximate 90 degree turn or elbow. In various implementations, input line 12 may include a plurality of output sections 14 at various relative heights measured from lowermost surface 3, for example. In this implementation, a plurality of output sections 14 are shown in dashed lines to represent that they may be optionally included. In various implementations, a lowermost output section 14 is directly adjacent a lowermost surface 3, and a plurality of sequentially stacked output sections 14 are disposed in a medial region between the lowermost surface 3 and uppermost surface 2, e.g., about 20%-80% of the height between lowermost surface 3 and uppermost surface 2. At least one advantage of this configuration may be that that the output sections 14 direct refrigerant along a flow path that is aligned with coils 24 (represented by swirling arrows).

Suction superheater 100 may include a refrigerant output line 16 that is disposed within the interior cavity of tank 1 and having a substantially U-shaped including an inlet opening 16*a*, first portion 16*b*, second portion 16*c*, and a third portion 16*d* joining the first portion 16*b* and second portion 16*c* together. Inlet opening 16*a* may draw vaporized and/or semi vaporized refrigerant into refrigerant output line 16. In this implementation, the first portion 16*b* extends in a substantially longitudinal direction from inlet opening 16*a*, which is adjacent the uppermost surface 2, to the third portion 16*d*, which is adjacent the lowermost surface 3. The second portion 16*c* extends in a substantially longitudinal direction from third portion 16*d* towards and through the uppermost surface 2 to output port 16*e*. In the example implementation, the third portion 16*d* may include a small orifice 18 (also referred to as a metering orifice) for allowing oil that has accumulated at the bottom of tank 1 to re-enter the output line 16 for lubricating a downstream compressor or pump.

Suction superheater 100 may include a heating line 20 for receiving a heated fluid from an external source. The heated fluid may increase the interior temperature of the cavity of tank 1 thereby warming the refrigerant introduced into the system via refrigerant input line 12. Any suitable type of heating fluid may be used and it may be provided from any type of suitable space or source (as will be described further below). Example heating fluids may include, gases, water, glycol, glycol water mixtures, oil, synthetic heat exchanger fluids, graphene, ammonia, and various types of refrigerant, and combinations thereof. Heating line 20 may include an input port 22 disposed at a lower region of tank 1 adjacent lowermost surface 3 and generally extend in a coiled arrangement from a lower region of tank 1 towards an upper region of tank 1 where heating line 20 may exit through the sidewall of tank 1 at output port 26. In various implementations, heating line 20 may comprise a plurality of sequentially stacked coil portions 24 that generally follow the interior shape of tank 1. In this implementation a cylindrical tank having circular shaped coil portions 24 that surround the input line 12 and output line 16. For example, an outside diameter of the circular shape of the coils 24 may correspond to an interior diameter of the circular shape of tank 1. At least one advantage of this sequentially stacked coil arrangement may be the relative increase in available surface area of heating line 20 which can transfer thermodynamic heat, i.e., heating line 20 has a relatively great thermodynamic potential. FIG. 2B is an alternate implementation of a superheater having the same, similar, and/or substantially the same features and functionality as explained above. However, in this implementation, suction superheater 100 may include a plurality of fins 20*z* that increase the available surface area for transferring heat to the refrigerant inside of superheater 100. Additionally, a screen or filter 18*a* is shown over the oil return inlet to prevent material contamination from entering output refrigerant line 16, for example metal filings and debris that may damage downstream compressor.

Figure 3A:
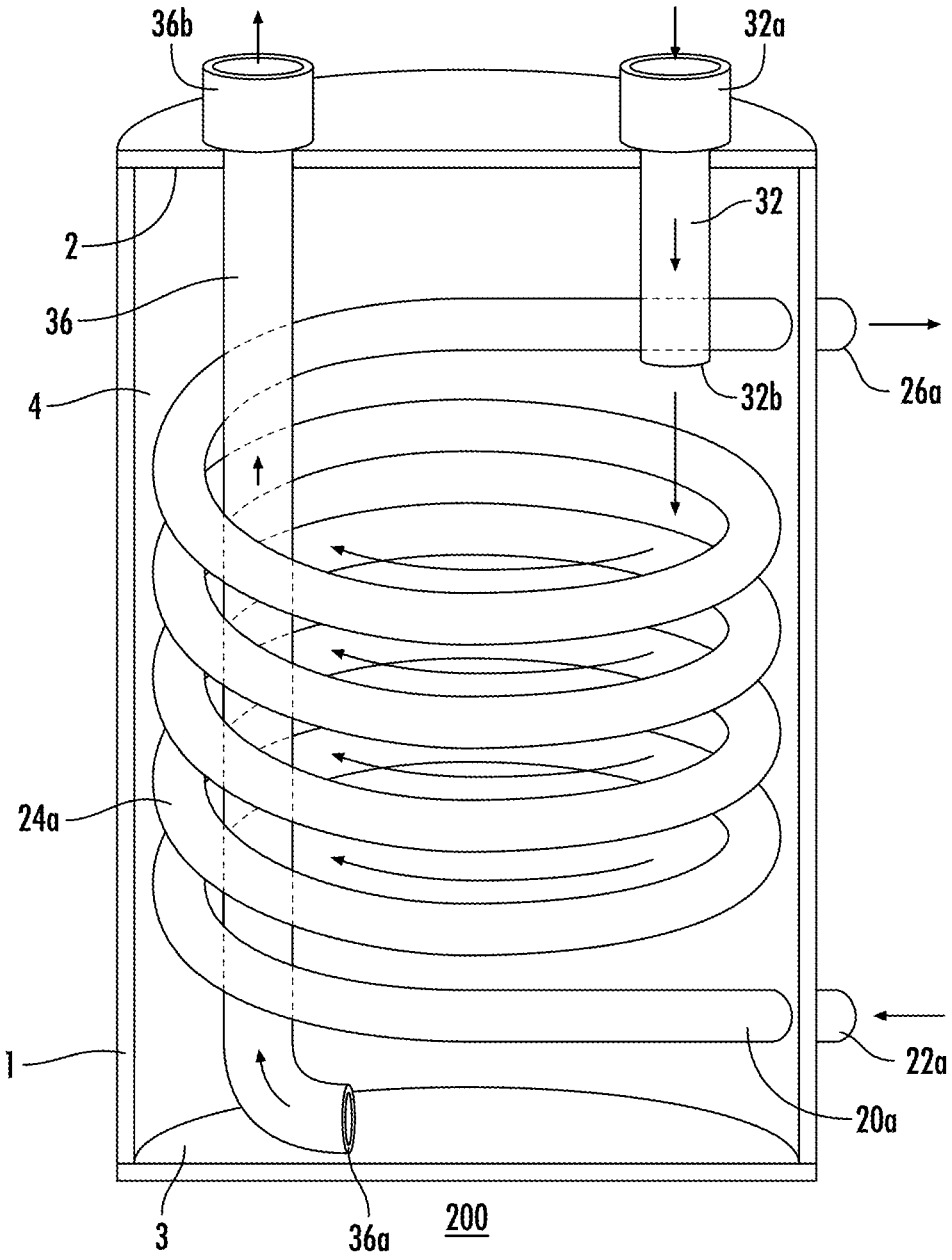
FIG. 3A is an exposed parts view of the interior of a first exemplary implementation of a desuperheater system including a heat exchanger for removing heat.
Figure 3B:
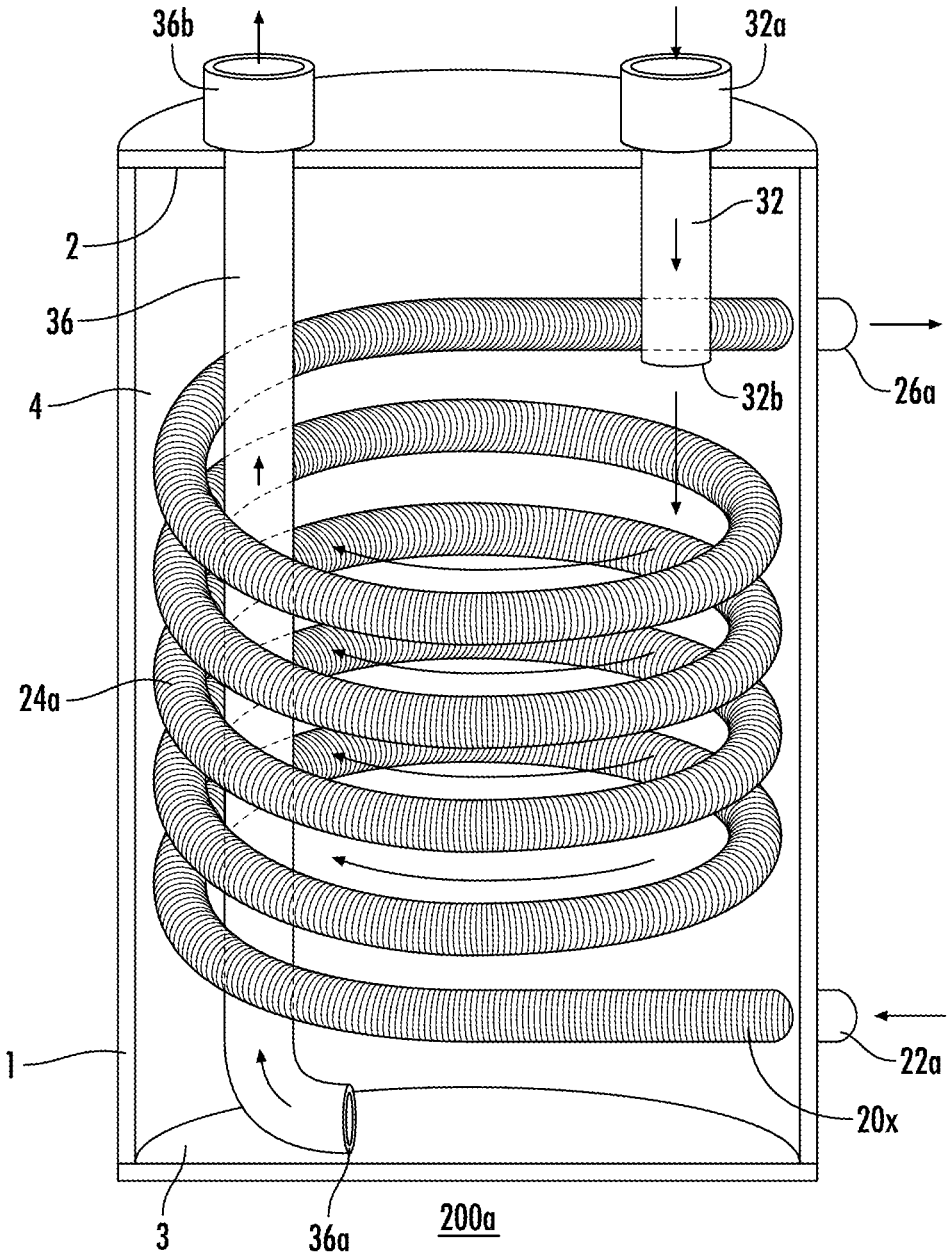
FIG. 3B is an exposed parts view of the interior of a second exemplary implementation of a desuperheater system including a heat exchanger for removing heat.

Referring generally to FIGS. 3A and 3B an exposed parts view of the interior of a first implementation of a desuperheater system 200 including a heat exchanger for removing heat is disclosed. In use, desuperheater 200 may be positioned downstream of a compressor and may be used to remove heat from refrigerant in the conduit lines and/or transfer heat from refrigerant in the conduit lines to an external location such as a holding tank. In the example implementation, desuperheater 200 make take the same and/or similar shape as suction superheater 100 and may generally be defined by a tank 1. Accordingly, duplicative description of the general shape and relative axes of desuperheater 200 will be omitted for brevity.

In various implementations, refrigerant may enter desuperheater 200 via input port 32*a* of refrigerant input line 32. Input line 32 may enter tank 1 by passing through the uppermost surface 2 in a substantially longitudinal direction and may include at least one outlet opening 32*b* for releasing the refrigerant into the interior of tank 1. In this implementation, outlet opening 32*b* is arranged at a relative height corresponding to an upper region of the interior cavity of the tank 1 proximate uppermost surface 2, for example. In various implementations, outlet opening 32*b* may be curved to direct refrigerant in a lateral direction along coils 24 if desired (not illustrated).

Desuperheater 200 may include a refrigerant output line 36 that is disposed within the interior cavity of tank 1 for drawing refrigerant from the interior of tank 1 and conveying it outside of tank 1 to output port 36*b*. Inlet opening 36*a* may draw vaporized and/or semi vaporized refrigerant into refrigerant output line 36 from a lower region of tank 1 adjacent lowermost surface 3, for example. In this implementation, the region of output line 36 corresponding to inlet opening 36*a* may be a curved section resulting in a lateral facing inlet opening 36*a* that is disposed directly adjacent lowermost surface 3. However, opening 36*a* may be disposed at alternate locations and/or relative heights from lower most surface 3. The remaining portion of output line 36 may extend in a longitudinal direction from a lower region of tank 1 towards uppermost surface 2 and exit the interior of tank 1 at output port 36*b*, for example.

Desuperheater 200 may include a heating removing line 20*a* for conveying heat from inside tank 1 to an external source or holding tank. In various implementations, the heat removing line 20*a* may include a fluid that enters tank 1 at a first relatively cool temperature and exits tank 1 at a second relatively warmer temperature. The fluid entering tank 1 may decrease the interior temperature of the cavity of tank 1 thereby cooling the refrigerant introduced into the system via refrigerant input line 32. Any suitable type of fluid may be used and it may be provided from any type of suitable space (as will be described further below). Example fluids may include, gases, water, glycol, glycol water mixtures, oil, synthetic heat exchanger fluids, graphene, ammonia, and various types of refrigerant, and combinations thereof. Heat removing line 20*a* may include an input port 22*a* disposed at a lower region of tank 1 adjacent lowermost surface 3 and generally extending in a coiled arrangement from a lower region of tank 1 towards an upper region of tank 1 where heat removing line 20*a* may exit through the sidewall of tank 1 at output port 26*a*. In various implementations, heat removing line 20 may comprise a plurality of sequentially stacked coil portions 24*a* that generally follow the interior shape of tank 1. In this implementation a cylindrical tank having circular shaped coil portions 24 that surround the input line 12 and output line 16. For example, an outside diameter of the circular shape of the coils 24*a* may correspond to an interior diameter of the circular shape of tank 1. At least one advantage of this sequentially stacked coil arrangement may be the relative increase in available surface area of heat removing line 20 which can transfer thermodynamic heat, i.e., heat removing line 20 has a relatively great thermodynamic potential. FIG. 3B is an alternate implementation of a desuperheater 200*a* having the same, similar, and/or substantially the same features and functionality as explained above. However, in this implementation, suction superheater 100 may include a plurality of fins 20*x* that increase the available surface area for transferring heat from the refrigerant inside of suction superheater 100 to an outside source or holding tank.

Figure 4:
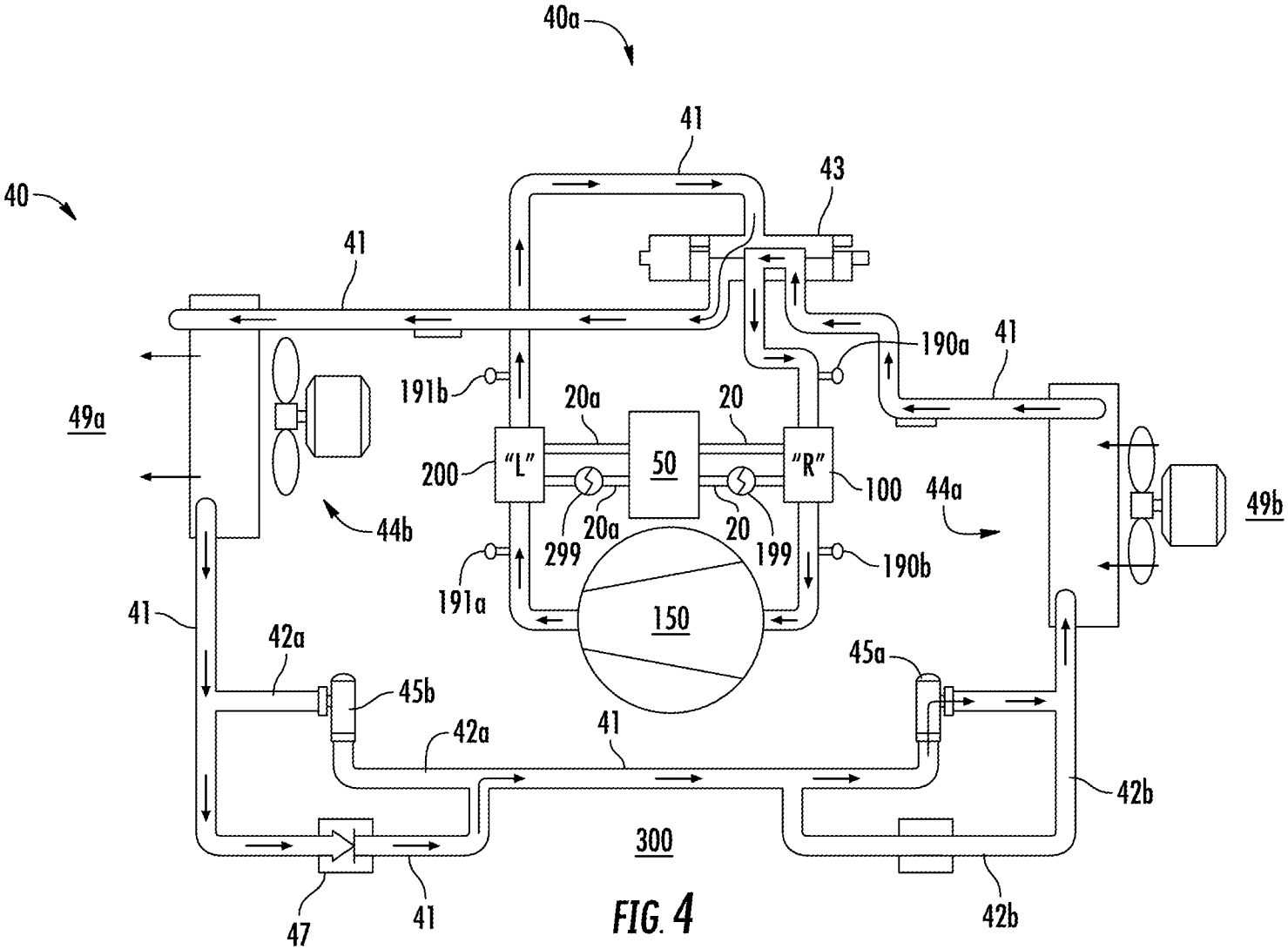
FIG. 4 is a schematic diagram of a conduit system including a heating, ventilation, and air conditioning system in a heating mode.

FIG. 4 is a schematic diagram of a heating and cooling optimization system 300 including a heating, ventilation, and air conditioning system in a heating mode. System 300 may include a conduit piping network 40 for conveying refrigerant, a fluid storage tank 50 for storing secondary fluid and/or refrigerant, and the suction superheater 100 and desuperheater 200. In the heating mode of FIG. 4, refrigerant may flow through a conduit piping network 40 along a heating flow path 41 (represented by arrows). When system 300 is in the heating mode, refrigerant will not traverse the first cooling branch portion 42*a* and/or second cooling branch portion 42*b* (represented by lack of arrows in branch portions 42*a*, 42*b*). For example, expansion valve 45*b* may be in a closed configuration and expansion valve 45*a* may be in an open configuration.

Beginning on the right-hand side of the page, refrigerant may flow through and from the outdoor evaporator coil and fan 44*a* towards reversing valve 43. The refrigerant circulating within evaporator coils and fan 44*a* may pick up heat and/or be warmed by the ambient temperature of outdoor space 49*b*. Once the relatively warmed refrigerant reaches the reversing valve 43 some of the refrigerant may enter a recirculating portion 40*a* of conduit system 40 (center of page). The recirculating portion 40*a* may include the above disclosed superheater 100, and desuperheater 200. Additionally, the recirculation portion 40*a* may include a compressor 150 that is downstream of suction superheater 100 and upstream of desuperheater 200. Furthermore at least one upstream sensor 190*a* may be in fluid communication with the conduit line 40 and/or refrigerant immediately upstream of suction superheater 100 and at least one downstream sensor 190*b* may be in fluid communication with the conduit line 40 and/or refrigerant immediately downstream of superheater 100, for example. Similarly, at least one third upstream sensor 191*a* may be in fluid communication with the conduit line 40 and/or refrigerant immediately upstream of desuperheater 200 and at least one fourth downstream sensor 191*b* may be in fluid communication with the conduit line 40 and/or refrigerant immediately downstream of desuperheater 200, for example. In various implementations, the at least one sensors 190*a*, 190*b*, 191*a*, and 191*b* may be configured to detect the temperature of the refrigerant, a flow volume of the refrigerant, and/or a pressure of the refrigerant at the corresponding location and convey this information to other components of system 300, e.g., for modulating a flow rate of pumps 199, 299. Once refrigerant leaves suction superheater 100 it may travel towards compressor 150 which may include any suitable motor for drawing and circulating the refrigerant in conduit lines 40. Once the refrigerant leaves compressor 150 the refrigerant may travel through desuperheater 200 and back towards reversible valve 43 where the refrigerant can branch off towards recirculating path 40*a* and/or towards an outdoor evaporator and fan 44*b*.

Consistent with the disclosure herein, a secondary fluid for introducing heat into the tank 1 of suction superheater 100 may travel from charging tank 50 along line 20 and into superheater 100. The relatively warm secondary fluid may be warmer than the refrigerant inside of tank 1 and thereby convey heat energy to the refrigerant and warm the interior of the tank 1 of superheater 100. After the secondary fluid has circulated within coils 24 of suction superheater 100 the secondary fluid may travel back to the charging tank 50. Although desuperheater 200 is illustrated as being in fluid communication with charging tank 50 via lines 20*a* and pump 299 it shall be understood that the desuperheater heater 200 and pump 299 are not activated in the heating mode of FIG. 4.

Refrigerant that has reached the indoor condenser and fan 44*b* may be used to heat the indoor conditioned space 49*a*. Refrigerant may exit the indoor condenser and fan 44*b* along cooling flow path 41 towards check valve 47. In this heating mode, the refrigerant does not flow through branch portion 42*a* on account of expansion valve 45*b* remaining in a closed position. The refrigerant may then flow along heating flow path 41 and towards expansion valve 45*a*. In this heating mode, the refrigerant does not flow through branch portion 42*b* on account of expansion valve 45*a* being in the open position. Thereafter, refrigerant may flow past expansion valve 45*a* and on to the outdoor evaporator coils and fan 44*a* to start the cycle over again.

Figure 5:
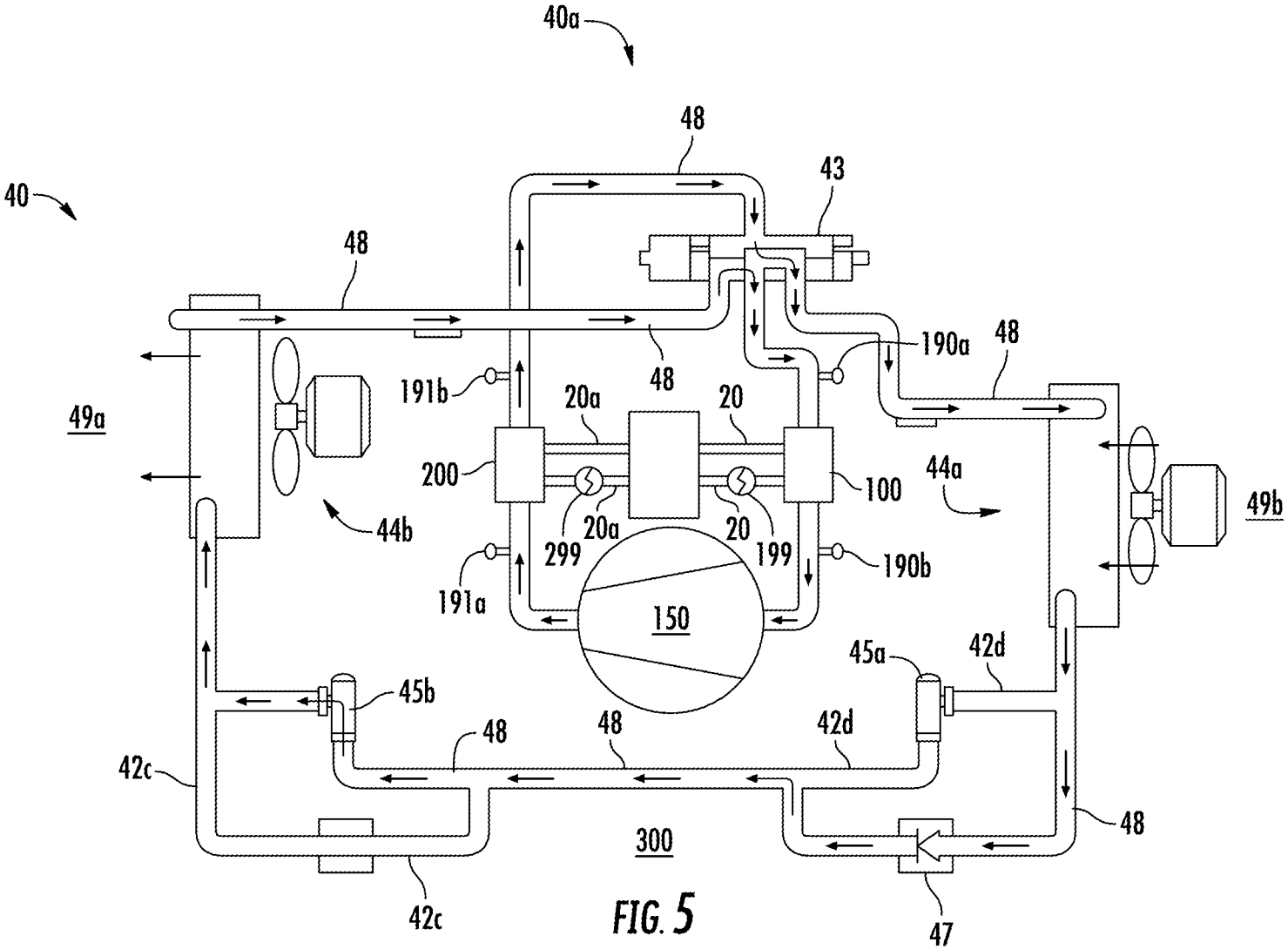
FIG. 5 is a schematic diagram of a conduit system including a heating, ventilation, and air conditioning system in a cooling mode.

FIG. 5 is a schematic diagram of a heating and cooling optimization system 300 including a heating, ventilation, and air conditioning system in a cooling mode. System 300 may include a conduit piping network 40 for conveying refrigerant, a fluid storage tank 50 for storing secondary fluid and/or refrigerant, and the suction superheater 100 and desuperheater 200. In the cooling mode of FIG. 5, refrigerant may flow through a conduit piping network 40 along a cooling flow path 48 (represented by arrows). When system 300 is in the cooling mode, refrigerant will not traverse the third branch portion 42*c* and/or fourth branch portion 42*d* (represented by lack of arrows in branch portions 42*c*, 42*d*). For example, expansion valve 45*a* may be in a closed configuration and expansion valve 45*b* may be in an open configuration. The relative open and closed configurations of expansion valves 45*a*, 45*b* is opposite from the heating mode explained above with respect to FIG. 4.

Beginning on the left-hand side of the page, refrigerant may flow through and from the indoor condenser coil and fan 44*b* towards reversing valve 43. The refrigerant circulating within evaporator coils and fan 44*b* may be cooled by the ambient temperature of the indoor conditioned space 49*a*. Once the relatively cooled refrigerant reaches the reversing valve 43 some of the refrigerant may enter a recirculating portion 40*a* of conduit system 40 (center of page). The recirculating portion 40*a* may include the above disclosed superheater 100, and desuperheater 200. Additionally, the recirculation portion 40*a* may include a compressor 150 that is downstream of suction superheater 100 and upstream of desuperheater 200. Furthermore at least one first upstream sensor 190*a* may be in fluid communication with the conduit line 40 and/or refrigerant immediately upstream of suction superheater 100 and at least one second downstream sensor 190*b* may be in fluid communication with the conduit line 40 and/or refrigerant immediately downstream of superheater 100, for example. Similarly, at least one third upstream sensor 191*a* may be in fluid communication with the conduit line 40 and/or refrigerant immediately upstream of desuperheater 200 and at least one fourth downstream sensor 191*b* may be in fluid communication with the conduit line 40 and/or refrigerant immediately downstream of desuperheater 200, for example. In various implementations, the at least one sensors 190*a*, 190*b*, 191*a*, and 191*b* may be configured to detect the temperature of the refrigerant, a flow volume of the refrigerant, and/or a pressure of the refrigerant at the corresponding location and convey this information to other components of system 300, e.g., for modulating a flow rate of pumps 199, 299. Once refrigerant leaves suction superheater 100 it may travel towards compressor 150 which may include any suitable motor for drawing and circulating the refrigerant in conduit lines 40. Once the refrigerant leaves compressor 150 the refrigerant may travel through desuperheater 200 and back towards reversible valve 43 where the refrigerant can branch of towards recirculating path 40*a* and/or towards an indoor condenser and fan 44*b*.

Consistent with the disclosure herein, a secondary fluid for removing heat and/or cooling the tank 1 of desuperheater 200 may travel from charging tank 50 along line 20*a* and into desuperheater 200. The relatively cool secondary fluid may be cooler than the refrigerant inside of tank 1 and thereby remove heat energy of the refrigerant and cool the interior of the tank 1 of desuperheater 200. After the secondary fluid has circulated within coils 24 of superheater 200 the secondary fluid may travel back to the charging tank 50. Although suction superheater 100 is illustrated as being in fluid communication with charging tank 50 via lines 20 and pump 199 it shall be understood that the super heater 100 and pump 199 are not activated in the cooling mode of FIG. 5.

Refrigerant that has reached the outdoor coil evaporator and fan 44*a* may be used to release heat to the outdoor space 49*b*. Refrigerant may exit the outdoor coil evaporator and fan 44*a* along cooling flow path 48 towards check valve 47. In this cooling mode, the refrigerant does not flow through branch portion 42*d* on account of expansion valve 45*a* remaining in a closed position. The refrigerant may then flow along cooling flow path 48 and towards expansion valve 45*b*. In this cooling mode, the refrigerant does not flow through branch portion 42*c* on account of expansion valve 45*b* being in the open position. Thereafter, refrigerant may flow past expansion valve 45*b* and on to the indoor condenser coils and fan 44*b* to start the cycle over again.

Figure 6A:
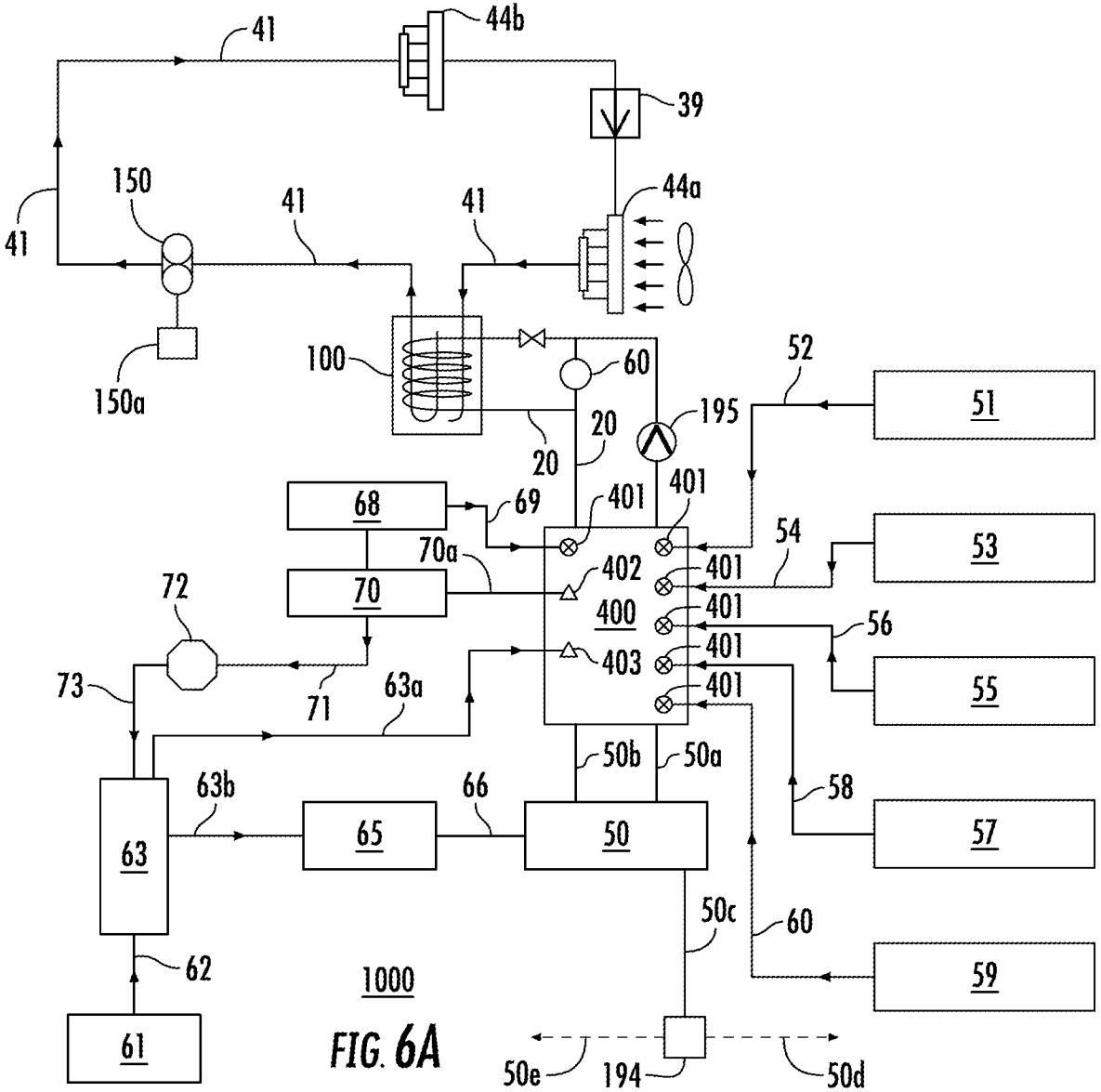
FIG. 6A is a schematic diagram of a heat source optimization and storage system including a suction superheater in a heating mode.
Figure 6B:
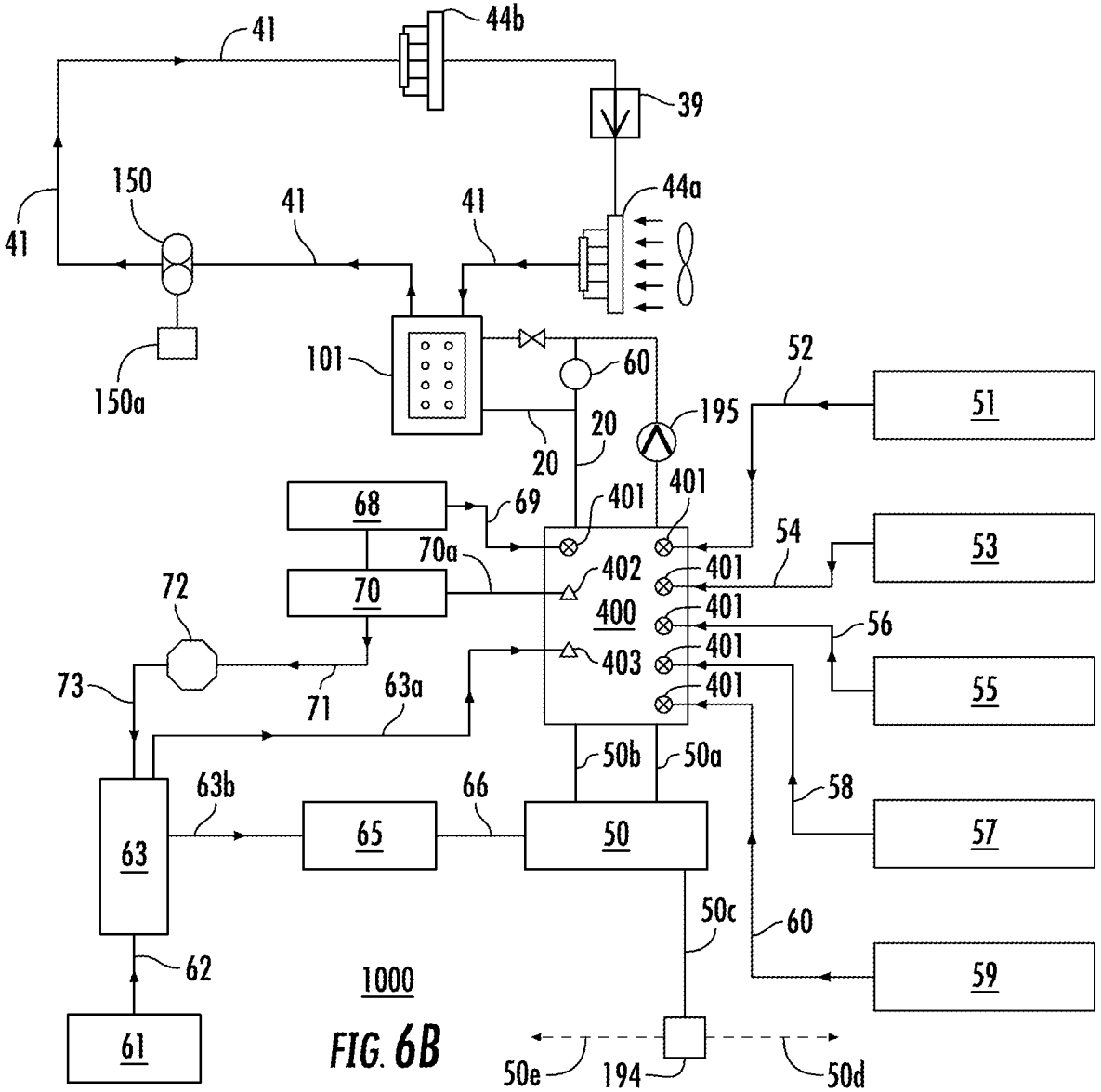
FIG. 6B is a schematic diagram of a heat source optimization and storage system including a brazed plate superheater in a heating mode.
Figure 6C:
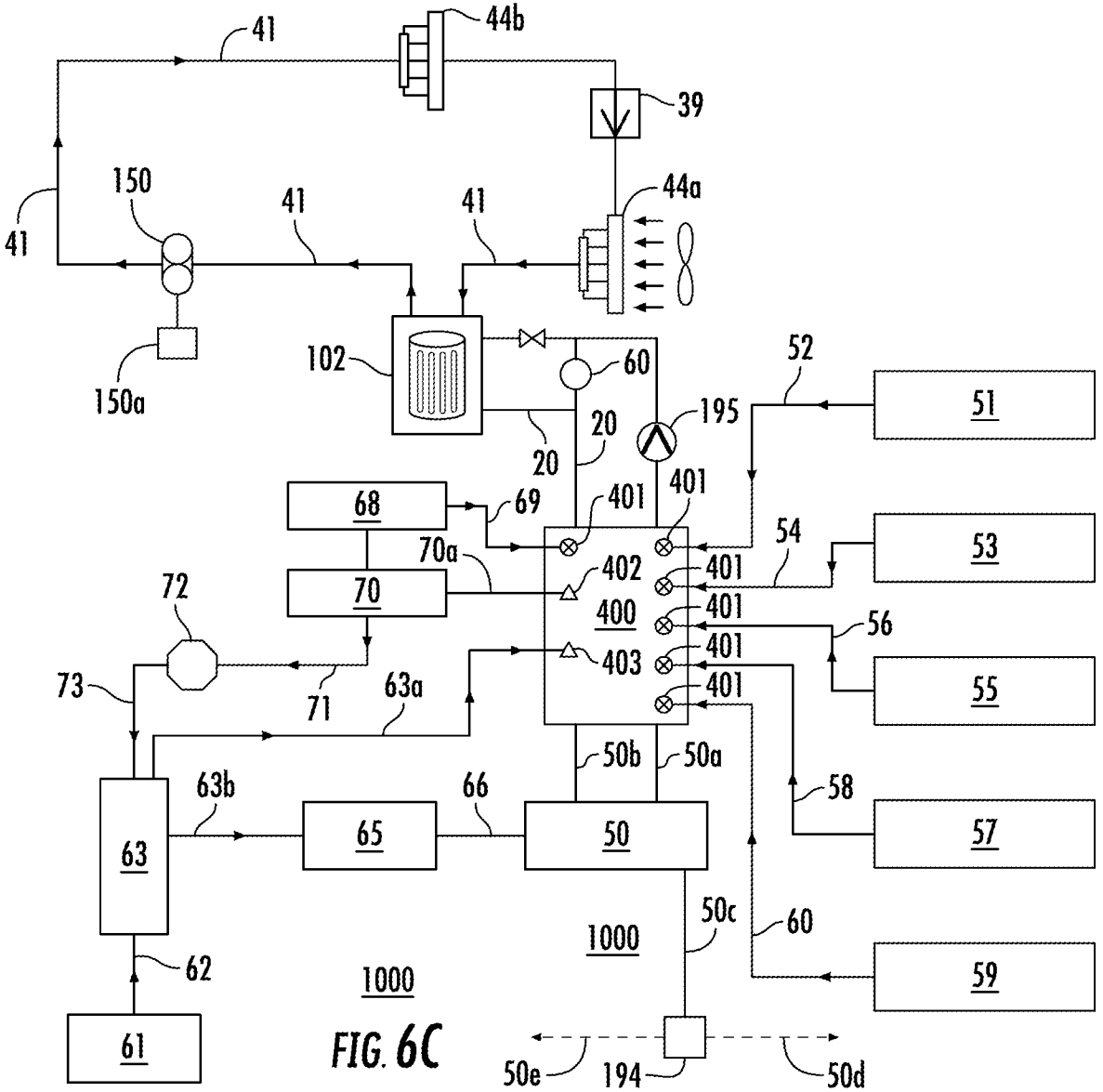
FIG. 6C is a schematic diagram of a heat source optimization and storage system including a tube and shell superheater in a heating mode.

Referring generally to FIGS. 6A-6C various schematic diagrams of heat source optimization systems are disclosed. FIG. 6A is a schematic diagram of a heat source optimization and storage system including a suction superheater 100 in a heating mode; FIG. 6B is a schematic diagram of a heat source optimization and storage system including a brazed plate superheater 101 in a heating mode; and FIG. 6C is a schematic diagram of a heat source optimization and storage system including a tube and shell superheater 102 in a heating mode. Attributes of system 1000 may be the same, similar, and/or substantially the same as system 300 explained above with reference to the heating mode of FIG. 4. Accordingly, similar numbering of parts will be used and previously explained components and functionality will may not be explained again and/or only briefly summarized. An aspect of system 1000, is that other components and/or sources to provide thermodynamic energy (heat source energy) to suction superheater 100 are explained in the context of a comprehensive system for a home, building, organization, etc. Of course, the principles explained herein can be adapted to any type of building, environment, and/or conditioned space on an as needed basis taking into account the particular resources, customs, laws, etc. of the relevant locality. Accordingly, various components described herein should be considered as example sources which explain the numerous ways in which the spirit of the disclosed implementations and teachings herein may be practiced by those skilled in the art. For example, various ways to introduce heat by providing a relatively hot fluid into superheater 100, various ways to remove heat by introducing a relatively chilled fluid into desuperheater 200, various sources for obtaining heating fluid, various sources for obtaining chilled fluids, and various operating modalities for modulating a fluid flow of either or both of the heated fluids and/or chilled fluids via a controller. For example, a programmable controller containing various circuits and integrated control logic for actuating pumps, solenoids, valves, etc. via electrical control signals and/or wireless control signals.

Briefly, system 1000 may be configured in a heating mode in which refrigerant circulates along a heating flow path 41 similarly as explained above. In this implementation, heating flow path 41 may omit some components for brevity in explanation. FIG. 6A shows heating flow path 41 includes a thermal expansion valve 39 (and/or the previously explained structures of an expansion valve 45*a*, 45*b*, and/or check valve 47) that allows relatively cool refrigerant to flow to the outdoor coil 44*a*. Thereafter, the refrigerant may be warmed and exit the outdoor coil 44*a* towards suction superheater 100 along heating flow path 41 as explained previously. Thereafter, vaporized and/or semi vaporized refrigerant may exit the suction superheater 100 along heating flow path 41 towards compressor 150 and motor 150*a* and go on to warm a conditioned interior air space and repeat the cycle again.

FIG. 6B includes the same, similar, and/or substantially the same components and functionality as FIG. 6A. However, in this embodiment system 1000 may include a plate heat exchanger 101 in lieu of suction superheater 100. In this embodiment, a plate heat exchanger 101 may be a relatively small compact brazed plate heat exchanger 101 that may be used to transfer heat into system 1000 by increasing the temperature of the refrigerant downstream of the compressor, for example. A brazed plate 101 may be used for transferring heat into system 1000 from any of the heat sources disclosed herein similarly as explained herein with respect to suction superheater 100. A brazed plate heat exchanger 101 may include a plurality of sequentially spaced apart plates inside of a chamber for transferring heat from a heat source to the refrigerant. The plates may have any type of corrugation, gasket, or surface texturing for increasing surface area and the thermodynamic transfer potential of the plate heat exchanger 101. The brazed plate heat exchanger 101 may include a manifold system allowing the refrigerant and secondary fluid to flow through manifold system, along the plurality of plates, and thereby transferring heat between the two mediums across the plates. The refrigerant and the secondary heated fluid will remain completely separated from each other by the gaskets and plates such that they do not mix but heat may be transferred between the two fluid mediums. In some embodiments, brazed plate heat exchanger 101 may be used without a suction line accumulator. In other embodiments, a brazed plate heat exchanger 101 may be used in addition to a suction line accumulator, for example the brazed plate heat exchanger may be disposed immediately upstream of the suction line accumulator.

FIG. 6C includes the same, similar, and/or substantially the same components and functionality as FIGS. 6A and 6B. However, in this embodiment system 1000 may include a shell and tube heat exchanger (also known as a tube and shell heat exchanger) 102 in lieu of suction superheater 100 (or brazed plate heat exchanger 101). In this embodiment, a shell and tube heat exchanger may be a relatively small compact canister that may be used to transfer heat into system 1000 by increasing the temperature of the refrigerant downstream of the compressor. A shell and tube heat exchanger 102 may be used for transferring heat into system 1000 from any of the heat sources disclosed herein similarly as explained herein with respect to suction superheater 100 and/or brazed plate heat exchanger 101. Shell and tube heat exchanger 102 may include a shell or canister similar to the tank of suction superheater 100, for example. The shell may have an input orifice to receive refrigerant into the interior of the tank and an exit orifice such that refrigerant may exit the tank. Additionally, a collection, or bundle, of tubes that form a separated interior flow path for the secondary fluid may be disposed inside of the shell or canister. The bundle of tubes may have a separate dedicated inflow port and outflow port for allowing secondary fluid to flow therein. The refrigerant and the secondary heated fluid are separated, or completely separated, from each other by a closed system formed by the bundle of tubes (an interconnected tube network) and the refrigerant may flow along the outside of the bundle of tubes thereby being warmed by the secondary heated fluid inside of the bundle of tubes. Secondary fluid may come from any of the disclosed heat sources herein and may travel into and through the bundle of tubes inside of the shell and warm the refrigerant inside of the shell. In this way, the refrigerant that exits the shell and tube heat exchanger 102 may be warmer than the refrigerant that enters the shell and tube heat exchanger 102.

FIGS. 6A-6C illustrate a heating source optimization manifold 400 that can selectively allow and/or control the fluid flow of various types of secondary fluids with suitable valves, solenoids, pumps, motors, etc. (represented by plural components 401 tied to individual supply lines). In various embodiments, manifold 400 may circulate a first type of secondary fluid to suction superheater 100 (or brazed plate heat exchanger 101 and/or shell and tube heat exchanger 102) and back to manifold 400 where manifold 400 allows for heat exchange between any of the various secondary fluids utilized by any of the disclosed heat sources descried herein. In one example, manifold 400 allows for a refrigerant fluid to circulate back and forth between suction superheater 200 and manifold 400 where manifold 400 allows for a heat exchange process between a natural water source (such as a pond or lake) and the refrigerant to occur without mixing the two fluid sources. In this way, the natural water source may warm the refrigerant via a heat exchange process occurring at manifold 400, e.g., any type of heat exchanger such as a brazed plate heat exchanger and/or a tube and shell heat exchanger.

It shall be understood that manifold 400 is used herein to explain how to manage a plurality of heat sources and storage sources and of course the system 1000 may be modified to utilize a single heat source and/or storage source without manifold 400. In at least one relatively simplified embodiment, ground loop 55 may be directly connected to suction superheater 100, brazed plate heat exchanger 101, and/or tube and shell heat exchanger 102 without manifold 400 and the other disclosed heat sources.

In the embodiments of FIGS. 6A-6C, such secondary fluids may provide relatively warm heated fluid to manifold 400 that may be stored in an insulated storage and/or charging tank 50 and/or passed directly to superheater 200 via heating lines 20. In some implementations, the secondary fluids can bypass the superheater 200 at bypass 60 on an as needed basis which may be determined by controller 63 and or temperature sensors 190*a*, 190*b*, for example. As explained previously, numerous heat sources may supply secondary heated fluid to manifold 400, e.g., a forest wood chip boiler 51 may heat a holding tank housing the secondary fluid and such secondary fluid may be heated and then provided to manifold 400 via first heating line 52. A geothermal heat source 53 may provide secondary heated fluid to manifold 400 via second heating line 52. For example, a geothermal heat source 53 may be any natural heat source such as a hot spring, steam vent, geyser, underwater vent, hydrothermal vent, etc. Such natural heat sources may heat a localized holding tank containing the secondary fluid which may be heated and then provided to manifold 400 via second heating line 54. A ground loop system 55 may heat a reservoir containing the secondary fluid which may be heated and then provided to manifold 400 via third heating line 56. A chemical heat source 57 may heat a reservoir containing the secondary fluid which may be heated and then provided to manifold 400 via fourth heating line 58. In yet another example, a solar thermal heat source 68 (such as a black water tank on the roof of a building) may collect heat during the day and when warmed the relatively warm secondary fluid may be provided to manifold 400. Similarly, a solar thermal photovoltaic system 70 and/or solar array 70 may harness the suns energy to produce electricity and the localized heat of the solar cells may be harnessed and provided directly to the manifold 400 along line 70*a*.

Additionally, the electrical energy generated by solar array 70 may also be provided to battery 72 along electrical lines 71. In turn the electrical energy stored in battery 72 may be transferred along electrical lines 73 and be used to power controller 63. In this example, controller 63 is in electrical communication with manifold 400 along electrical line 63*a* and electric water heater 65 along electric line 63*b*. In this way, controller 63 can determine if it is beneficial to route electrical energy to manifold 400 to activate and/or modulate the various valves 401 and/or heat the manifold 400 by an electric heater 403, for example. Controller 63 may also receive electrical power from the grid 61 via local power system lines 62 in addition to or alternatively from battery 72.

As should be appreciated, any type of heat source may be used to provide a secondary heated fluid to manifold 400. For example, alternate heat sources 59 may provide a heated secondary fluid to manifold 400. Such alternate heat sources may come from a man-made environment to take advantage of built up thermodynamic potential. In one example, heat may be transferred from a garage where thermodynamic energy may build up due to the heat emanating from an engine block, for example. Such heat may be transferred by geothermal wall panels adjacent to the heated engine block which store a secondary fluid that when warmed may be provided to manifold 400. In another example, a fan coil may be installed in an attic space or any other space where heat is known to consolidate. The fan coil may activate when the attic space reaches a specific temperature and thereby transfer heat energy from the attic by conveying secondary fluid to the manifold 400. Once heated secondary fluid is provided to manifold 400 it may either be stored in manifold 400, provided directly to suction superheater 100 along heating lines 20 as previously explained. Additional example heat sources may include: basements, swimming pools, ponds, hot tubs, saunas, ovens, refrigerator/freezer coils, clothes washers and dryers, driveways, sidewalks, concrete slabs in basements and patio homes, roofs, roof decking, walls, septic tanks, sewer and water lines, (and in particular, southern-facing walls in the Northern Hemisphere and northern facing walls in the Southern Hemisphere), and additionally in commercial/industrial applications, parking lots, discharge air plenums, wastewater plants, elevator shafts, stairwells, waste heat from manufacturing processes etc. Other heat sources may include natural environment sources, such as bodies of water like ponds, lakes, rivers, tidal pools, and the ocean. Additionally or alternatively, the thermodynamic energy from any of the above explained sources may be transferred to an insulated holding tank 50 to be easily used by disclosed systems. In various implementations, insulated holding tank 50 may be configured to store any secondary fluid.

In various implementations, secondary fluids stored in insulated holding tank 50 may be transferred back to any of the above-described sources to be recharged with thermodynamic energy. For example, secondary fluid may exit tank 50 along lines 50*c* towards return pump 194 where the secondary fluid can be routed back to any of the various sources along any number of necessary recharge lines, e.g., recharge lines 50*e*, 50*d*.

Figure 7:
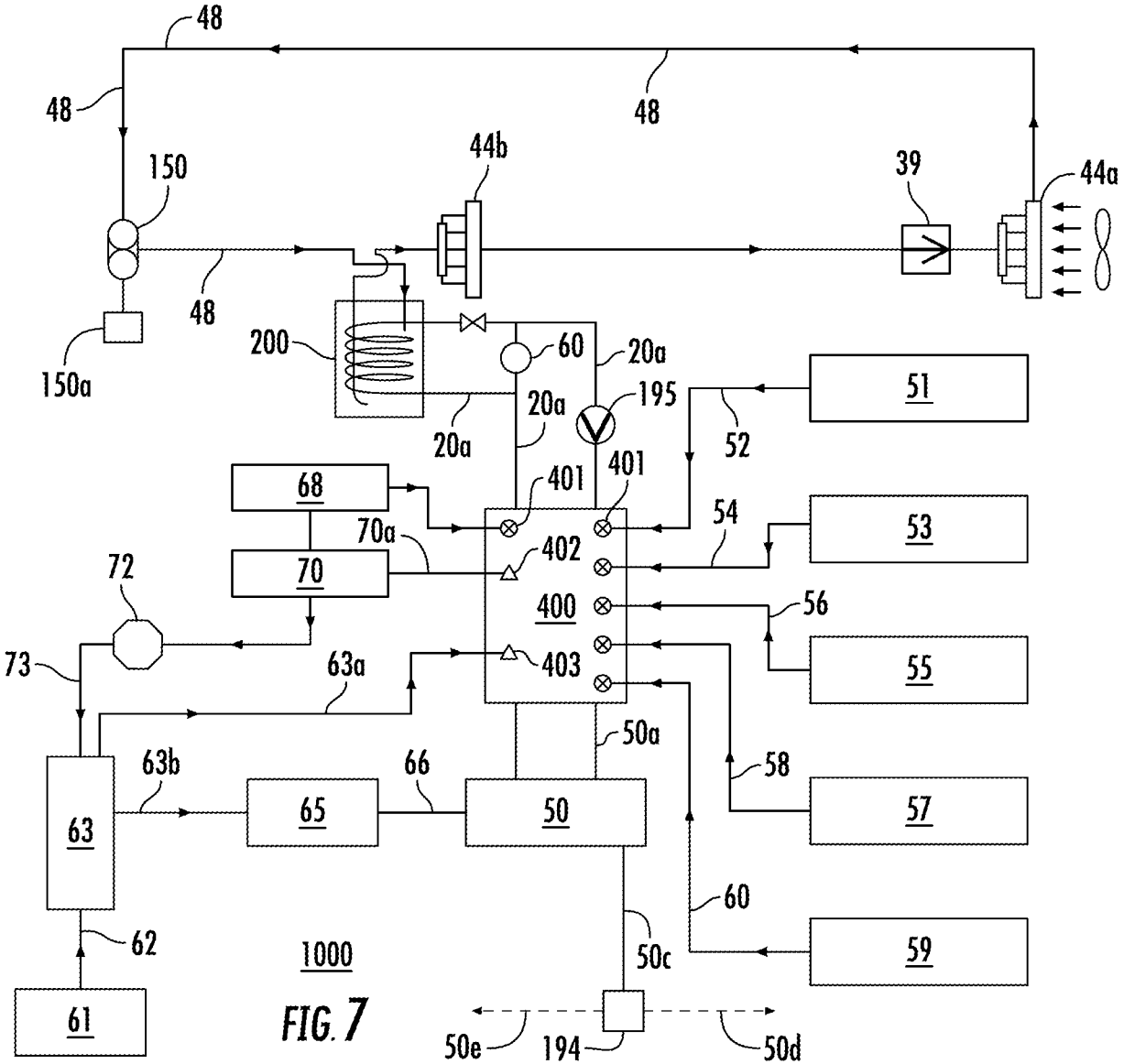
FIG. 7 is a schematic diagram of a heat source optimization and storage system in a cooling mode.

FIG. 7 is a schematic diagram of a heat source optimization and storage system 1000 in a cooling mode. System 1000 may include the same, similar, and/or substantially the same components and functionality as explained above with respect to FIG. 6. Attributes of system 1000 may be the same, similar, and/or substantially the same as system 300 explained above with reference to the cooling mode of FIG. 5. Accordingly, similar numbering of parts will be used and previously explained components and functionality will may not be explained again and/or only briefly summarized. Consistent with the disclosure herein, a comprehensive system may utilize both a heat exchanger (suction superheater 100, brazed plate heat exchanger 101, and/or tube and shell heat exchanger 102) and a heat remover (de-super heater 200) as previously explained with respect to FIGS. 4 and 5. An aspect of system 1000 shown in FIG. 7, is that other components and/or sources may be used to remove thermodynamic energy (heat source energy) via desuperheater 200. In essence, the configuration of FIG. 7 is in the reverse of FIG. 6 where heat is removed from cooling flow path 48 by circulating a relatively cool secondary fluid to desuperheater 200.

In various embodiments, manifold 400 may circulate a first type of secondary fluid to de-superheater 200 and back to manifold 400 where manifold 400 allows for heat exchange between any of the various secondary fluids utilized by any of the disclosed sources descried herein. In one example, manifold 400 allows for a first refrigerant fluid to circulate back and forth between de-superheater 200 and manifold 400 where manifold 400 allows for a heat exchange process between a second refrigerant fluid of a ground loop 55. In this way, heat energy may be removed from system 1000 by transferring the heat energy of system 1000 (captured by first refrigerant circulating in de-superheater) that is conveyed to manifold 400 where the heat energy of the first refrigerant is transferred to the second refrigerant and stored in ground loop 55. In an alternate example, the fluid lines of ground loop 55 may be directly connected to de-superheater 200 in lieu of being indirectly connected via manifold 400. In another alternate example, manifold 400 allows for a first refrigerant fluid to circulate back and forth between de-superheater 200 and manifold 400 where manifold 400 allows for a heat exchange process between a potable fluid source such as a storage tank 50 or water tank 65, for example. In this way, heat energy may be removed from system 1000 by transferring the heat energy of system 1000 (captured by first refrigerant circulating in de-superheater 200) that is conveyed to manifold 400 where the heat energy of the first refrigerant is transferred to the potable water fluid and stored in storage tank 50. In an alternate example, the potable fluid lines of storage tank 50 may be directly connected to de-superheater 200 in lieu of being indirectly connected via manifold 400.

System 1000 may be configured in a cooling mode in which refrigerant circulates along a cooling flow path 48 similarly as explained above. In this implementation, cooling flow path 48 may omit some components for brevity in explanation. FIG. 7 shows cooling flow path 48 includes an indoor coil and fan 44*b*, a thermal expansion valve 39, and an outdoor coils and fan 44*a*. In operation, the refrigerant may flow from indoor coil and fan 44*b* to thermal expansion valve 39 and on to outdoor coils and fan 44*a* to release heat to the outside environment. The refrigerant may flow from outdoor coils and fan 44*a* along fluid flow path 48 back to compressor 150 and pump 150*a* and through desuperheater 200, for example as explained above.

In this cooling implementation, valve 195 is reversed to allow secondary fluid to flow into the heating source optimization manifold 400. As explained above manifold 400 can selectively allow and/or control the fluid flow of various secondary fluids with suitable valves, solenoids, pumps, motors, etc. (represented by plural components 401 tied to individual supply lines). Such secondary fluids may provide relatively cool fluid to manifold 400 that may be stored in an insulated storage and/or charging tank 50 and/or passed directly to desuperheater 200 via cooling lines 20*a*. In some implementations, the secondary fluids can bypass the desuperheater 200 at bypass 60 on an as needed basis which may be determined by controller 63 and/or temperature sensors 191*a*, 191*b*, for example. Additionally, any of the various thermodynamic sources 51, 53, 55, 57, 59 can be modulated and/or turned off such that cooled secondary fluid is provided to manifold. For example, ground loop 57 may tap into a relatively cool aquifer and cool a secondary fluid that is circulated to manifold 400. Additionally, at nighttime cool water in solar tank 68 may be transferred to manifold 400 and/or stored in holding tank 50.

In various embodiments, thermodynamic energy may be removed from system 1000 and stored in a ground loop. For example, heat from system 1000 may be removed via desuperheater 200 and transferred to ground loop system 55 via third heating line 56. This arrangement has the advantage of being able to store heat energy that is built up and transfer that heat energy into ground loop system 55 for use at a later time. In another embodiment, heat energy from a solar thermal heat source 68 may be transferred directly to ground loop system 55. For example, heat that is built up during the day by solar thermal heat source 68 may be transferred along fluid line 69 to manifold system 400 and then along fluid line 56 to ground loop system 55.

Figure 8:
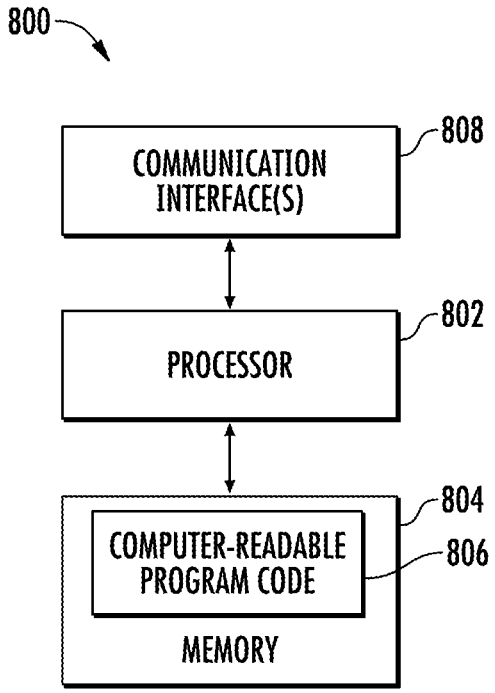
FIG. 8 illustrates an apparatus that according to some examples may be configured to at least partially implement a controller system in accordance with example implementations.

FIG. 8 illustrates an example flow diagram explaining how a controller system 800 can be utilized to modulate a flow rate of the secondary fluids during a heating mode of FIGS. 4 and 6 and the cooling mode of FIGS. 5 and 7. In various implementations and examples discussed herein, controller system 800 and associated circuitry (not shown) may be connected to or otherwise receive information from signals indicating the operating state of various components of superheater 100, desuperheater 200, system 300, and/or system 1000 during one or more modes of operation. In one example, controller can receive information from sensors 190*a*, 190*b*, 191*a*, and 191*b*, for example. And further, controller system 800 through such circuitry may directly control such components. Controller system 800 may be configured to control the valves referenced herein and may also be used to control operation of motor 150*a*, compressor 150, pumps 199, 299, valves 45*b*, 45*a*, etc. As will be appreciated by those skilled in the art, in one implementation includes multiple sensors, actuators, transducers, detection devices, and/or annunciators referred to collectively herein as communication interfaces 808 (FIG. 8) (not all being shown), and may be used in association with the various components of various disclosed systems and components.

A first example use of controller 800 as a comparator will be explained with reference to the heating mode of FIG. 4. In this example, the upstream sensor 190*a* and downstream sensor 190*b* are used to collect data about the status of the refrigerant immediately before entering the suction superheater 100 and immediately after exiting the superheater 100, respectively. At a first moment in time, sensor 190*a* may detect that refrigerant entering the suction superheater 100 is at a first temperature that is relatively cool, e.g., reference temperature "XX" degrees and that the temperature of the refrigerant exiting the suction superheater 100 is at a second temperature that is relatively warm, e.g. XX+5 degrees. Next, the controller 800 can compare the temperature of the refrigerant exiting the suction superheater 100 to a table of target temperature ranges and/or acceptable temperature ranges that are pre-programmed and stored in memory of the controller 800. In this instance, the second temperature is below the target acceptable temperature range and the controller 800 may send a signal to pump 199 to increase a flow rate of secondary fluid being supplied to superheater 100. Additionally, controller 800 may send a control signal to manifold 400 to acquire additional heated secondary fluid from any of the sources disclosed above with reference to FIG. 6.

Next, at a second moment in time (later than the first moment in time) sensor 190*a* may detect that refrigerant entering the suction superheater 100 is at a third temperature that is slightly warmer, e.g., XX+5 degrees and that the temperature of the refrigerant exiting the suction superheater 100 is at a fourth temperature that is fairly warm, e.g. XX+15 degrees. Next, the controller 800 may compare the temperature of the refrigerant exiting the suction superheater 100 to a table of acceptable temperatures pre-programmed and stored in memory of the controller 800 as explained previously. In this instance, the fourth temperature is within the acceptable temperature range and the controller 800 may send a signal to pump 199 to continue supplying secondary fluid to suction superheater 100 at the same flow rate.

Next, at a third moment in time (later than the first and second moments in time) sensor 190*a* may detect that refrigerant entering the suction superheater 100 is at a fifth temperature that is slightly warmer, e.g., XX+15 degrees and that the temperature of the refrigerant exiting the suction superheater 100 is at a sixth temperature that is very warm, e.g. XX+25 degrees. Next, the controller 800 may compare the temperature of the refrigerant exiting the suction superheater 100 to a table of acceptable temperatures pre-programmed and stored in memory of the controller 800 as explained previously. In this instance, the sixth temperature is greater than the acceptable temperature range and the controller 800 may send a signal to pump 199 to stop supplying secondary fluid to suction superheater 100 and/or to modulate the flow rate until the temperature measured by sensor 190*b* decreases to fall within the acceptable temperature range. For example, the above described iterative process may be broadly understood as modulating the flow rate of the secondary fluid via pump 199 by measuring an intake temperature of the refrigerant entering into the suction superheater 100 and measuring an outtake temperature of the refrigerant exiting the suction superheater 100 such that the temperature of the refrigerant is modulated by controlling a flow rate of the secondary heated fluid and/or by increasing the temperature of the secondary heated fluid via manifold 400.

Those with skill in the art, will readily appreciate that controller 800 can be configured to perform a substantially similar operation in a cooling mode and with respect to desuperheater 200 and sensors 191*a*, 191*b*. For example, controller 800 may be configured to modulate the flow rate of the relatively cool secondary fluid entering the desuperheater 200 via pump 299 by measuring an intake temperature of the refrigerant at sensor 191*a* and measuring an outtake temperature of the refrigerant exiting the desuperheater 200 at sensor 191*b*. In this way, the controller 800 can modulate the flow rate of the relatively cool secondary fluid by modulating the power supplied to pump 299 such that the temperature of the refrigerant is controlled by selectively increasing and decreasing a flow rate of the secondary fluid on an as needed basis. Additionally, as explained above, controller 800 can also communicate with manifold 400 to acquire additional chilled secondary fluid.

In various implementations, additional temperature sensors, flow rate sensors and/or pressure sensors (not illustrated) can be used to detect the incoming temperature, pressure, flow rates etc. of secondary fluids into and out of manifold 400 and/or storage tank 50. Any described sensor herein may be used singularly or in combination. Additionally, temperature sensors may be used to detect ambient temperature, such as of the air surrounding and circulating through a heat exchanger, for example condenser 128 and hot and chilled brazed plates 140, 170, respectively, and also for detecting the temperature of ground water and/or the temperature of ground (earth) water loops available to system 1000, for example. Such instrumentation may be connected to controller system 800 via hardwire, wirelessly, optically, sonically, and/or through other means to provide output signals and to communicate with the control circuitry of controller system 800 in a manner to allow controller system 800 to process, manipulate, scale, and make calculations and control decisions based on such signal inputs.

It is also to be understood that controller system 800 is not limited to information and/or signals received from such instrumentation, but could also draw information from and receive inputs from other sources, and such sources could be remote and received through wire or wireless connection with the Internet or communications via other means including, but not limited to, microwave, radio frequency, Bluetooth, hardwire, electricity transmission lines, telephone, and/and other available communication modalities. For example, such remote information could include current weather and/or weather forecast information obtained from the Internet which could bear on operation of system 1000. In accordance with example implementations, the one or more sensors perform one or more actions in response to conditions they sense individually and or collectively, in real-time (real-time generally herein including near real-time) during operation.

FIG. 8 illustrates a control system 800 that according to some examples may be configured to at least partially implement the operation of system 1000. Generally, the apparatus of exemplary implementations of the present disclosure may comprise, include or be embodied in one or more fixed, portable or embedded electronic devices. The apparatus may include one or more of each of a number of components such as, for example, a processor 802 comprising hardware and software connected to a memory 804. For each sensor, processor 802 may receive a measurement from the sensor.

The processor 802 is generally any piece or component of computer hardware that is capable of processing information such as, for example, data, computer-readable program code, instructions or the like (at times generally referred to as "computer programs," e.g., software, firmware, etc.), and/or other suitable electronic information. The processor is composed of a collection of electronic circuits some of which may be packaged as an integrated circuit or multiple interconnected integrated circuits (an integrated circuit at times more commonly referred to as a "chip"). The processor may be configured to execute computer programs, which may be stored onboard the processor or otherwise stored in the memory 804 (of the same or another apparatus).

The processor 802 may be a number of processors, a multi-processor core or some other type of processor, depending on the particular implementation. Further, the processor may be implemented using a number of heterogeneous processor systems in which a main processor is present with one or more secondary processors on a single chip. As another illustrative example, the processor may be a symmetric multi-processor system containing multiple processors of the same type. In yet another example, the processor may be embodied as or otherwise include one or more application-specific integrated circuits (ASICs), field-programmable gate arrays (FPGAs) or the like. Thus, although the processor may be capable of executing a computer program to perform one or more functions, the processor of various examples may be capable of performing one or more functions without the aid of a computer program.

The memory 804 is generally any piece or component of computer hardware that is capable of storing information such as, for example, data, computer programs (e.g., computer-readable program code 806) and/or other suitable information either on a temporary basis and/or a permanent basis. The memory may include volatile and/or non-volatile memory, and may be fixed or removable. Examples of suitable memory include random access memory (RAM), read-only memory (ROM), a hard drive, a flash memory, a thumb drive, a removable computer diskette, an optical disk, a magnetic tape or some combination of the above. Optical disks may include compact disc-read only memory (CD-ROM), compact disc-read/write (CD-R/W), digital versatile disc (DVD) or other standard media and format. In various instances, the memory may be referred to as a computer-readable storage medium which, as a non-transitory device capable of storing information, may be distinguishable from computer-readable transmission media such as electronic transitory signals capable of carrying information from one location to another. Computer-readable medium as described herein may generally refer to a computer-readable storage medium or computer-readable transmission medium.

In addition to the memory 804, the processor 802 may also be connected to one or more of the communication interfaces 808 for displaying, transmitting and/or receiving information. The communications interface may be configured to transmit and/or receive information, such as to and/or from other apparatus(es), network(s) or the like. The communications interface may be configured to transmit and/or receive information by physical (wireline) and/or wireless communications links. Examples of suitable communication interfaces include a network interface controller (NIC), wireless NIC (WNIC) or the like.

As indicated above, program code instructions may be stored in memory, and executed by a processor, to implement functions of the systems, subsystems and their respective elements described herein. As will be appreciated, any suitable program code instructions may be loaded onto a computer comprising hardware and software, or other programmable apparatus from a computer-readable storage medium to produce a particular machine, such that the particular machine becomes a means for implementing the functions specified herein. These program code instructions may also be stored in a computer-readable storage medium that can direct a computer, a processor or other programmable apparatus to function in a particular manner to thereby generate a particular machine or particular article of manufacture. The instructions stored in the computer-readable storage medium may produce an article of manufacture, where the article of manufacture becomes a means for implementing functions described herein. The program code instructions may be retrieved from a computer-readable storage medium and loaded into a computer, processor or other programmable apparatus to configure the computer, processor or other programmable apparatus to execute operations to be performed on or by the computer, processor or other programmable apparatus. Retrieval, loading and execution of the program code instructions may be performed sequentially such that one instruction is retrieved, loaded and executed at a time. In some example implementations, retrieval, loading and/or execution may be performed in parallel such that multiple instructions are retrieved, loaded, and/or executed together. Execution of the program code instructions may produce a computer-implemented process such that the instructions executed by the computer, processor or other programmable apparatus provide operations for implementing functions described herein.

Execution of instructions by a processor, or storage of instructions in a computer-readable storage medium, supports combinations of operations for performing the specified functions. In this manner, an apparatus 800 may include a processor 802 and a computer-readable storage medium or memory 804 coupled to the processor, where the processor is configured to execute computer-readable program code 806 stored in the memory. It will also be understood that one or more functions, and combinations of functions, may be implemented by special purpose hardware-based computer systems and/or processors which perform the specified functions, or combinations of special purpose hardware and program code instructions.

It should be understood that various aspects disclosed herein may be combined in different combinations than the combinations specifically presented in the description and accompanying drawings. For example, features, functionality, and components from one implementation may be combined with another implementation and vice versa unless the context clearly indicates otherwise. Similarly, features, functionality, and components may be omitted unless the context clearly indicates otherwise. It should also be understood that, depending on the example, certain acts or events of any of the processes or methods described herein may be performed in a different sequence, may be added, merged, or left out altogether (e.g., all described acts or events may not be necessary to carry out the techniques).

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof

What is claimed is:

1. A heat optimization system, comprising:

a suction superheater, comprising:

a tank extending in a longitudinal direction, the tank defining an interior cavity having an uppermost surface, a lowermost surface opposite the uppermost surface, and a sidewall extending from the uppermost surface to the lowermost surface, the interior cavity including an upper region proximate the uppermost surface, a lower region proximate the lowermost surface, and a medial region between the upper region and lower region;

a refrigerant input line disposed within the tank and extending from the upper region to at least the medial region, the refrigerant input line being configured to receive input refrigerant from a first supply line outside the tank in a vaporized state, semi-vaporized state, and/or a saturated state and release the input refrigerant into the interior cavity through a first output orifice proximate the medial region and/or a second output orifice proximate the lower region;

a refrigerant output line disposed within the tank and having a U-shaped comprising a first portion and a second portion joined together by a third portion, the first portion extending from an input orifice proximate the upper region to the third portion, the third portion being disposed proximate the lower region and including an oil return inlet therein, the second portion extending from the third portion to the upper region, the refrigerant output line being configured to draw vaporized refrigerant from within the tank through the input orifice and draw liquid refrigerant and/or oil from within the tank through the oil return inlet and provide the vaporized refrigerant, liquid refrigerant, and/or oil together as output refrigerant to a second supply line outside of the tank; and a heating line disposed within the tank, the heating line including a plurality of coils extending in the longitudinal direction from a first region adjacent the uppermost surface to a second region adjacent the lowermost surface, the heating line being configured to receive a heated fluid from an external heat source;

wherein the heating line increases the temperature of the input refrigerant.

2. An apparatus, comprising:

a chamber defining an interior cavity having an upper wall portion, a lower wall portion, and a sidewall portion extending between the upper wall portion and the lower wall portion;

a first conduit disposed within the chamber and extending from proximate the upper wall portion to proximate the sidewall portion; the first conduit being configured to receive refrigerant from a refrigerant supply outside the chamber in a vaporized state and/or a saturated state and discharge the refrigerant into the interior cavity through at least one discharge orifice proximate the sidewall portion and/or proximate the lower wall portion;

a generally U-shaped second conduit disposed within the interior cavity having an inlet port proximate the upper wall, a discharge port extending from the interior cavity to outside the chamber, and an oil return inlet proximate the lower wall portion; the inlet port being configured to intake vaporized or semi-vaporized refrigerant from the interior cavity, the oil return inlet being configured to intake liquid refrigerant and/or oil from the interior cavity, and the second conduit being configured to deliver vaporized refrigerant from the inlet port and liquid refrigerant from the oil return inlet to the discharge port outside of the chamber; and a fluid conduit disposed within the interior cavity and extending from a first region adjacent the upper wall portion to a second region adjacent the lower wall portion, the fluid conduit being configured to receive a heated fluid from a heat source external to the chamber, wherein the heated fluid acting through the fluid conduit increases the temperature of the refrigerant in at least one of the interior cavity, the first conduit, and the second conduit.

3. The apparatus of claim 2, wherein the first conduit is further configured to discharge the refrigerant into the interior cavity through a plurality of discharge orifices, the plurality of discharge orifices including the at least one discharge orifice.

4. The apparatus of claim 3, wherein:

the fluid conduit comprises a plurality of sequentially stacked coils that are stacked in a longitudinal direction of the tank from the first region to the second region;

the plurality of sequentially stacked coils comprise a corresponding gap space between adjacent coils of the plurality of sequentially stacked coils; and each discharge orifice of the plurality of discharge orifices is configured to discharge the refrigerant at a different elevation, each different elevation corresponding spatially to a gap space.

5. The apparatus of claim 2, wherein the oil return inlet is disposed at a lowermost section of the U-shaped second conduit.

6. The apparatus of claim 2, wherein the heated fluid comprises glycol.

7. The apparatus of claim 2, further comprising a plurality of discharge orifices, including the at least one discharge orifice.

8. The apparatus of claim 7, wherein each discharge orifice of the plurality of discharge orifices is disposed at a different elevation relative to the lower wall portion.

9. The apparatus of claim 7, wherein:

the plurality of discharge orifices is sequentially stacked at substantially equal spacing intervals in a vertical direction, and wherein each discharge orifice of the plurality of discharge orifices is configured to discharge refrigerant in a direction substantially parallel to an adjacent one coil of the plurality of sequentially stacked coils.

* * * * *